US009999254B2

(12) United States Patent
Liu

(10) Patent No.: US 9,999,254 B2
(45) Date of Patent: Jun. 19, 2018

(54) E-CIGARETTE. AND E-CIGARETTE ATOMIZER AND MOUTHPIECE THEREOF

(71) Applicant: SHENZHEN BUDDY TECHNOLOGY DEVELOPMENT CO., LTD., Shenzhen (CN)

(72) Inventor: Xiang Liu, Shenzhen (CN)

(73) Assignee: SHENZHEN BUDDY TECHNOLOGY DEVELOPMENT CO., LTD., Shenzhen, Guangdong (CN)

( * ) Notice: Subject to any disclaimer, the term of this patent is extended or adjusted under 35 U.S.C. 154(b) by 0 days. days.

(21) Appl. No.: 15/405,732

(22) Filed: Jan. 13, 2017

(65) Prior Publication Data

US 2018/0103684 A1 Apr. 19, 2018

(30) Foreign Application Priority Data

Oct. 17, 2016 (CN) ..... 2016 2 1129802 U

(51) Int. Cl.
*A24F 13/00* (2006.01)
*A24F 47/00* (2006.01)
*A24F 7/02* (2006.01)

(52) U.S. Cl.
CPC ..... *A24F 47/008* (2013.01); *A24F 7/02* (2013.01)

(58) Field of Classification Search
CPC ..... A24F 47/008
USPC ..... 131/173–330
See application file for complete search history.

(56) References Cited

U.S. PATENT DOCUMENTS

D782,729 S 3/2017 Wright et al.
2016/0100633 A1* 4/2016 Gao ..... A24F 47/008 131/329
2016/0128387 A1* 5/2016 Chen ..... A24F 47/008 392/395
2016/0316820 A1* 11/2016 Liu ..... A24F 47/008
2017/0071252 A1 3/2017 Liu

FOREIGN PATENT DOCUMENTS

WO 2017045132 3/2017

* cited by examiner

*Primary Examiner* — Phuong Dinh
(74) *Attorney, Agent, or Firm* — Hamre, Schumann, Mueller & Larson, P.C.

(57) ABSTRACT

Disclosed is an e-cigarette, including an e-cigarette atomizer and a battery component. The e-cigarette atomizer includes an atomizer body and a mouthpiece. An open e-liquid chamber is provided at one end of the atomizer body. An air guide tube extending outwards is disposed in the open e-liquid chamber. A lock hook is provided at an end portion of the air guide tube. The air guide tube is inserted in a locking sleeve of a pluggable locking type mouthpiece and is in interference fit with the locking sleeve. The lock hook abuts against an end face of a clamp spring bar of the pluggable locking type mouthpiece to lock and connect the atomizer body and the pluggable locking type mouthpiece. A plug connector of the pluggable locking type mouthpiece is inserted in an opening of the open e-liquid chamber and closes the open e-liquid chamber. The present invention has a mouthpiece plug-in lock structure, capable of rapidly sealing and locking the open e-liquid chamber by means of the mouthpiece, and has advantages of being convenient and easy to mount and having a simple structure.

8 Claims, 4 Drawing Sheets

E-CIGARETTE. AND E-CIGARETTE ATOMIZER AND MOUTHPIECE THEREOF

BACKGROUND

Technical Field

The present invention relates to an e-cigarette, and more specifically, to an e-cigarette having a pluggable locking type mouthpiece and an electronic cigarette atomizer.

Related Art

An e-cigarette atomizer is a part, in an e-cigarette, configured to implement e-liquid storage and heating atomization, and therefore has a more complex structure as compared with a battery rod component. However, the existing e-cigarette atomizers have the following technical problems: (1) As a result of involving a great number of parts and a complex structure, there are problems of being cumbersome and complex to mount and including multiple steps. (2) For some e-cigarette atomizers, an e-liquid cannot be added or adding of an e-liquid needs a special instrument (a needle). (3) A connecting structure of a mouthpiece either adopts a thread structure, which takes time and energy to mount and dismount, or adopts a pluggable structure, which is not secure and reliable enough and is prone to wear and looseness.

SUMMARY

The problem to be resolved in the present invention: with respect to the problem in the prior art, provided are a pluggable locking type mouthpiece, an e-cigarette atomizer, and an e-cigarette, having a mouthpiece plug-in lock structure, where an open e-liquid chamber can be sealed and locked rapidly by means of a mouthpiece, the e-cigarette is easy and convenient to install, an e-liquid can be added conveniently without a special instrument, the mouthpiece can be connected rapidly and securely, and the structure is simple.

To resolve the technical problem, the technical solutions adopted in the present invention are as follows:

In one aspect, the present invention provides a pluggable locking type mouthpiece, including a mouthpiece body, where a locking sleeve is fixedly provided in an inner chamber of the mouthpiece body; two or more clamp spring bars are provided at an inner end portion of the locking sleeve; and a plug connector is provided at an outer end portion of the locking sleeve.

Preferably, the locking sleeve is secured in the inner chamber of the mouthpiece body by means of ultrasonic welding.

Preferably, a first sealing ring is sheathed around an outer wall of the plug connector.

Further, the present invention also provides an e-cigarette atomizer, including an atomizer body and a mouthpiece, where an open e-liquid chamber is provided at one end of the atomizer body; an air guide tube extending outwards is disposed in the open e-liquid chamber; a lock hook is provided at an end portion of the air guide tube; the mouthpiece is the foregoing pluggable locking type mouthpiece of the present invention; the air guide tube is inserted in a locking sleeve of the pluggable locking type mouthpiece and is in interference fit with the locking sleeve; the lock hook abuts against an end face of a clamp spring bar of the pluggable locking type mouthpiece to lock and connect the atomizer body and the pluggable locking type mouthpiece; and a plug connector of the pluggable locking type mouthpiece is inserted in an opening of the open e-liquid chamber and closes the open e-liquid chamber.

Preferably, a plurality of ribs is provided at an outer wall of the air guide tube; and the air guide tube is in interference fit with the locking sleeve by means of the plurality of ribs.

Preferably, a guide slope is provided at an end portion of the lock hook.

Preferably, the atomizer body includes a glass tube and a screw rod that are connected to each other; an atomization tube and an atomization base are provided in the glass tube; the air guide tube is inserted in the atomization base; the atomization tube is sheathed around an outer side of a connection section between the atomization base and the air guide tube; a second sealing ring is provided between the atomization base and an inner wall of the glass tube; the atomization base, an outer wall of the atomization tube, an outer wall of the air guide tube, and the inner wall of the glass tube enclose to form the open e-liquid chamber; an atomization core is provided in the atomization base; an electrode connector is provided in the screw rod; and an electrode of the atomization core is electrically connected to the electrode connector.

Preferably, the electrode connector includes an insulation sleeve and a thimble that is inserted and secured in the insulation sleeve; the screw rod and the thimble are both made of metal; and the electrode of the atomization core is electrically connected to the screw rod and the thimble, separately.

Further, the present invention also provides an e-cigarette, including an e-cigarette atomizer and a battery component, where the e-cigarette atomizer is the foregoing e-cigarette atomizer of the present invention.

The pluggable locking type mouthpiece of the present invention has the following advantages: a locking sleeve is fixedly provided in an inner chamber of a mouthpiece body of the pluggable locking type mouthpiece, two or more clamp spring bars are provided at an inner end portion of the locking sleeve, and a plug connector is provided at an outer end portion of the locking sleeve. Therefore, a function of plug-in automatic-lock with an e-cigarette atomizer can be implemented by means of the locking sleeve, and thus the pluggable locking type mouthpiece of the present invention can be locked with a matched e-cigarette atomizer when the two parts are inserted together. Moreover, by means of the plug connector, assembling of the atomizer and the mouthpiece enables the open e-liquid chamber of the atomizer to be closed to store an e-liquid. The mounting process of the e-cigarette atomizer and the mouthpiece can be effectively simplified, installation of the mouthpiece is secure and reliable, and the pluggable locking type mouthpiece of the present invention has advantages of being capable of implementing plug-in automatic-lock of the e-cigarette atomizer and the mouthpiece, and having a secure and reliable connection and a simple structure.

The e-cigarette atomizer of the present invention has the following advantages:

1. The e-cigarette atomizer of the present invention includes an atomizer body and a mouthpiece, an open e-liquid chamber is provided at one end of the atomizer body, and an air guide tube extending outwards is disposed in the open e-liquid chamber, thereby forming two major structures, namely, the atomizer body and a mouthpiece; moreover, assembling of the atomizer body and mouthpiece enables the open e-liquid chamber of the atomizer to be closed and serve as an e-liquid storage structure of the atomizer, thereby involving a small amount of parts and having a simple structure; and the air guide tube is inserted in the locking sleeve and the lock hook abuts against an end face of a clamp spring bar to lock and connect the atomizer body and the mouthpiece during assembling, thereby being capable of effectively simplifying the mounting process of the atomizer body and the mouthpiece.

2. In the present invention, two major structures, namely, the atomizer body and the mouthpiece, are formed, and assembling of the atomizer body and mouthpiece enables the open e-liquid chamber of the atomizer to be closed and serve as an e-liquid storage structure of the atomizer; an opening of the open e-liquid chamber is relatively large and the air guide tube is provided in the open e-liquid chamber and extends outwards, and therefore an e-liquid can be added manually without using a special instrument (a needle), and in particular, the e-liquid is poured into the open e-liquid chamber along the outer wall of the air guide tube, thereby having advantages of being convenient to add an e-liquid and not needing a special instrument.

3. A lock hook is provided at an end portion of the air guide tube of the present invention, a locking sleeve is fixedly secured in the mouthpiece, the air guide tube is inserted in the locking sleeve and is in interference fit with the locking sleeve, two or more clamp spring bars are provided at an inner end portion of the locking sleeve, and the lock hook abuts against end faces of the clamp spring bars to lock and connect the atomizer body and the mouthpiece; and secure connection between the two major structures, namely, the atomizer body and the mouthpiece, is implemented by using an automatic lock mechanism of the clamp spring bars and the lock hook, thereby having advantages of quick and secure connection of a mouthpiece and having a simple structure.

The e-cigarette of the present invention includes the foregoing e-cigarette atomizer of the present invention, and therefore also has the foregoing advantages of the e-cigarette atomizer of the present invention, which are not described again herein.

DESCRIPTION OF THE REFERENTIAL NUMERALS

Figure 1:
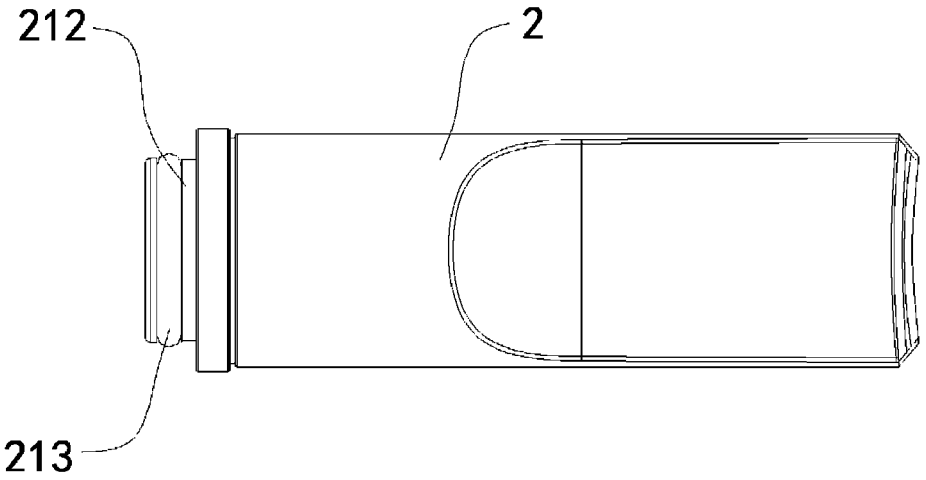
FIG. 1 is a schematic front structural diagram of a pluggable locking type mouthpiece according to an embodiment of the present invention.
Figure 2:
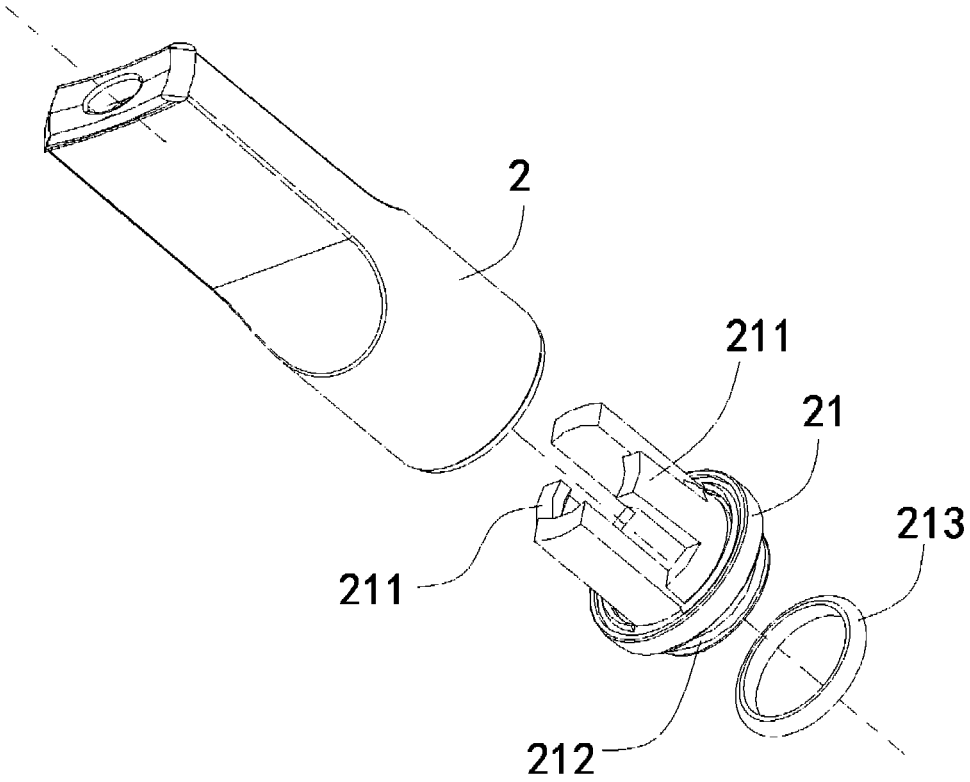
FIG. 2 is a schematic three-dimensional exploded structural diagram of the pluggable locking type mouthpiece according to an embodiment of the present invention.
Figure 3:
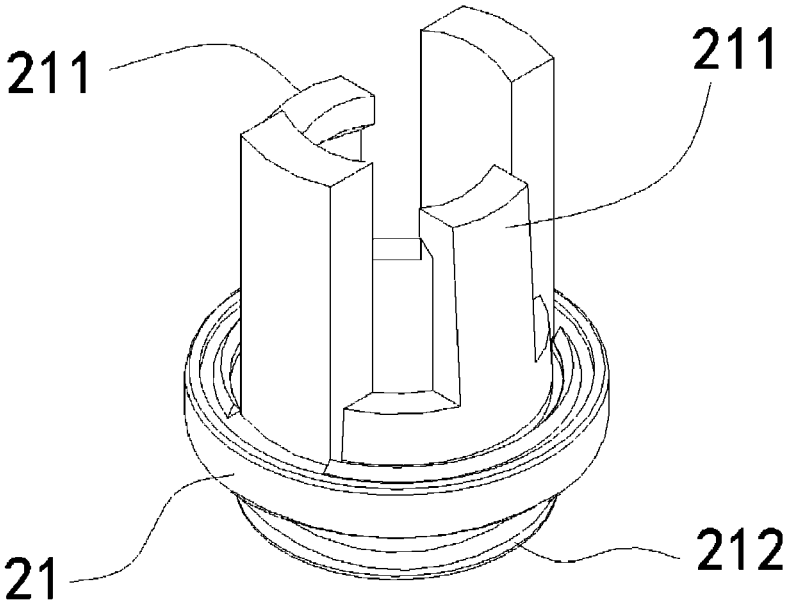
FIG. 3 is a schematic three-dimensional structural diagram of a locking sleeve according to an embodiment of the present invention.
Figure 4:
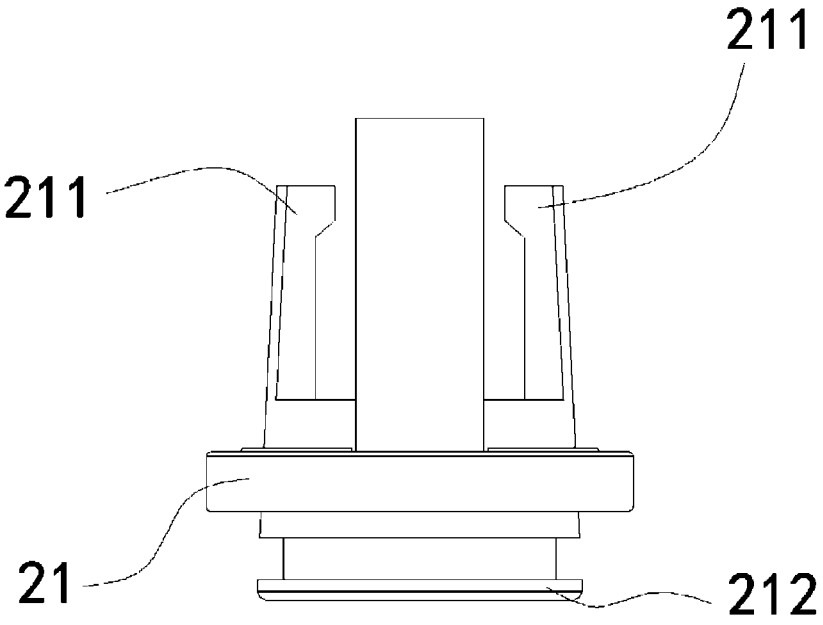
FIG. 4 is a schematic front structural diagram of the locking sleeve according to an embodiment of the present invention.

1. atomizer body; 11. glass tube; 12. screw rod; 13. atomization tube; 14. atomization base; 15. second sealing ring; 16. atomization core; 17. electrode connector; 171. insulation sleeve; 172. thimble; 2. mouthpiece; 21. locking sleeve; 211. clamp spring bar; 212. plug connector; 213. first sealing ring; 3. open e-liquid chamber; 4. air guide tube; 41. lock hook; 42. rib; 43. guide slope.

DETAILED DESCRIPTION

As shown in FIG. 1, FIG. 2, FIG. 3, and FIG. 4, a pluggable locking type mouthpiece in this embodiment includes a mouthpiece body 2. A locking sleeve 21 is fixedly provided in an inner chamber of the mouthpiece body 2. Two or more clamp spring bars 211 are provided at an inner end portion of the locking sleeve 21. A plug connector 212 is provided at an outer end portion of the locking sleeve 21. A function of plug-in automatic-lock with an e-cigarette atomizer can be implemented by means of the locking sleeve 21, and thus the pluggable locking type mouthpiece in this embodiment can be locked with a matched e-cigarette atomizer when the two parts are inserted together. Moreover, by means of the plug connector 212, assembling of the atomizer and the mouthpiece enables the open e-liquid chamber of the atomizer to be closed to store an e-liquid. The mounting process of the e-cigarette atomizer and the mouthpiece can be effectively simplified, installation of the mouthpiece is secure and reliable, and the pluggable locking type mouthpiece in this embodiment has advantages of being capable of implementing plug-in automatic-lock of the e-cigarette atomizer and the mouthpiece, and having a secure and reliable connection and a simple structure.

In this embodiment, the locking sleeve 21 is fixed in the inner chamber of the mouthpiece body 2 by means of ultrasonic welding. The ultrasonic welding is an existing manufacturing process, and has advantages of being environmental-friendly and sanitary and having a low cost as compared with the methods of adhering or clamping.

In this embodiment, a first sealing ring 213 is sheathed around an outer wall of the plug connector 212. Assembling of the atomizer and the mouthpiece enables the open e-liquid chamber of the atomizer to be closed to store an e-liquid, thereby improving the sealing performance and avoiding e-liquid leakage.

Figure 5:
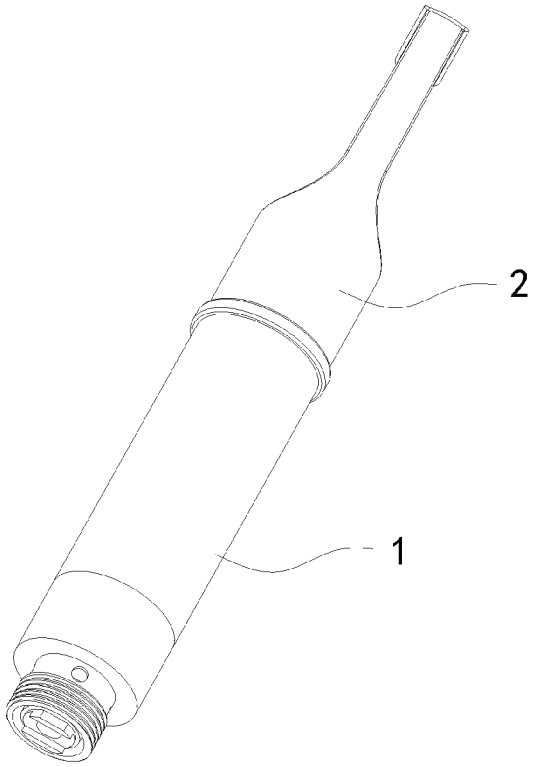
FIG. 5 is a schematic three-dimensional structural diagram of an e-cigarette atomizer according to an embodiment of the present invention.
Figure 6:
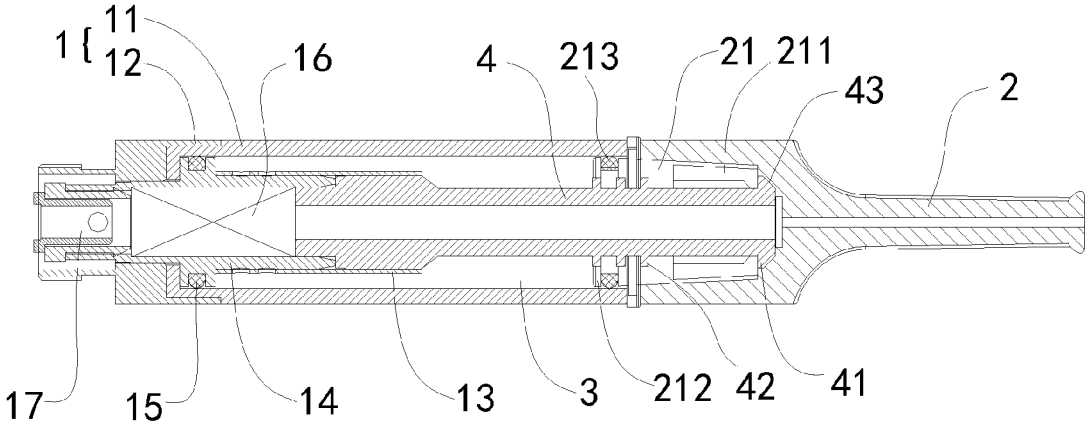
FIG. 6 is a schematic sectional structural diagram of the e-cigarette atomizer according to an embodiment of the present invention.
Figure 7:
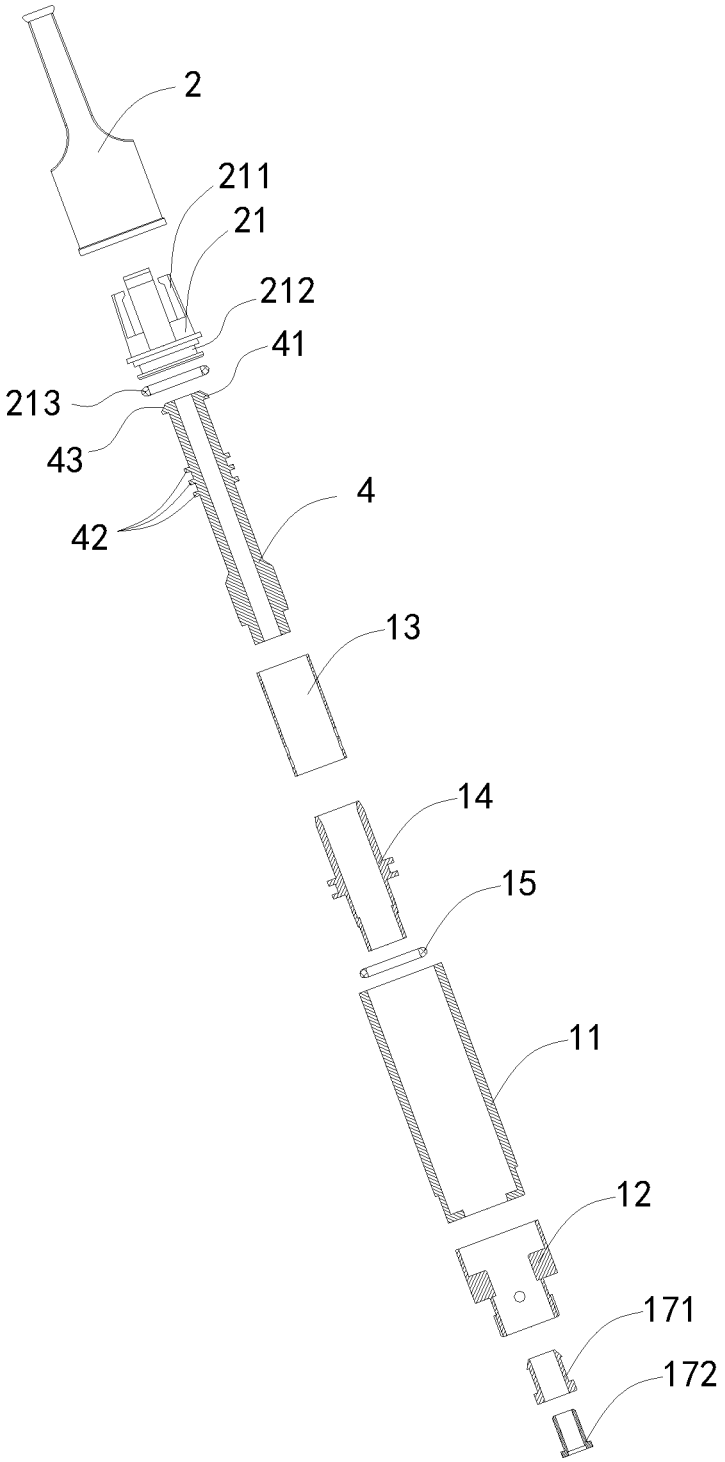
FIG. 7 is a schematic sectional exploded structural diagram of the e-cigarette atomizer according to an embodiment of the present invention.

As shown in FIG. 5, FIG. 6, and FIG. 7, an e-cigarette atomizer in this embodiment includes an atomizer body 1 and a mouthpiece. An open e-liquid chamber 3 is provided at one end of the atomizer body 1. An air guide tube 4 extending outwards is disposed in the open e-liquid chamber 3. A lock hook 41 is provided at an end portion of the air guide tube 4. The mouthpiece is the pluggable locking type mouthpiece shown in FIG. 1, FIG. 2, FIG. 3, and FIG. 4. The air guide tube 4 is inserted in a locking sleeve 21 of the pluggable locking type mouthpiece and is in interference fit with the locking sleeve 21. The lock hook 41 abuts against an end face of a clamp spring bar 211 of the pluggable locking type mouthpiece to lock and connect the atomizer body 1 and the pluggable locking type mouthpiece. A plug connector 212 of the pluggable locking type mouthpiece is inserted in an opening of the open e-liquid chamber 3 and closes the open e-liquid chamber 3. The e-cigarette atomizer in this embodiment includes two major structures, namely, the atomizer body 1 and the mouthpiece 2. Moreover, assembling of the atomizer body 1 and mouthpiece 2 enables the open e-liquid chamber 3 to be closed and serve as an e-liquid storage structure of the atomizer, thereby involving a small amount of parts and having a simple structure. Further, the air guide tube 4 is inserted in the locking sleeve 21 and the lock hook 41 abuts against an end face of a clamp spring bar 211 to lock and connect the atomizer body 1 and the mouthpiece 2 during assembling, thereby being capable of effectively simplifying the mounting process of the atomizer body 1 and the mouthpiece 2. Secondary, in this embodiment, assembling of the atomizer body 1 and mouthpiece 2 enables the open e-liquid chamber 3 to be closed and serve as an e-liquid storage structure of the atomizer. An opening of the open e-liquid chamber 3 is relatively large and the air guide tube 4 is provided in the open e-liquid chamber 3 and extends outwards, and therefore an e-liquid can be added manually without using a special instrument (a needle), and in particular, the e-liquid is poured into the open e-liquid chamber 3 along the outer wall of the air guide tube 4, thereby having advantages of being convenient to add an e-liquid and not needing a special instrument. Further, a lock hook 41 is provided at an end portion of the air guide tube 4 in this embodiment. A locking sleeve 21 is fixedly secured in the mouthpiece 2. The air guide tube 4 is inserted in the locking sleeve 21 and is in interference fit with the locking sleeve 21. Two or more clamp spring bars 211 are provided at an inner end portion of the locking sleeve 21. The lock hook 41 abuts against end faces of the clamp spring bars 211 to lock and connect the atomizer body 1 and the mouthpiece 2. Secure connection between the two major structures, namely, the atomizer body 1 and the mouthpiece 2, is implemented by using an automatic lock mechanism of the clamp spring bars 211 and the lock hook 41, thereby having advantages of quick and secure connection of a mouthpiece and having a simple structure.

As shown in FIG. 6 and FIG. 7, a plurality of ribs 42 is provided at an outer wall of the air guide tube 4. The air guide tube 4 is in interference fit with the locking sleeve 21 by means of the plurality of ribs 42. A labyrinth seal structure is formed between the air guide tube 4 and the locking sleeve 21 by means of a plurality of ribs 42. In combination with the structure of interference fit between the air guide tube 4 and the locking sleeve 21 by means of the plurality of ribs 42, the sealing performance between the air guide tube 4 and the locking sleeve 21 is guaranteed, and e-liquid leakage of the open e-liquid chamber 3 is avoided. Moreover, mounting of the first sealing ring 43 can be simplified by means of the ribs 42.

As shown in FIG. 6 and FIG. 7, a guide slope 43 is provided at an end portion of the lock hook 41, which guides the air guide tube 4 to insert into the locking sleeve 21, and therefore, insertion of the air guide tube 4 becomes labor-saving and convenient.

As shown in FIG. 6 and FIG. 7, the atomizer body 1 includes a glass tube 11 and a screw rod 12 that are connected to each other. An atomization tube 13 and an atomization base 14 are provided in the glass tube 11. The air guide tube 4 is inserted in the atomization base 14. The atomization tube 13 is sheathed around an outer side of a connection section between the atomization base 14 and the air guide tube 4. A second sealing ring 15 is provided between the atomization base 14 and an inner wall of the glass tube 11. The atomization base 14, an outer wall of the atomization tube 13, an outer wall of the air guide tube 4, and the inner wall of the glass tube 11 enclose to form the open e-liquid chamber 3. An atomization core 16 is provided in the atomization base 14. An electrode connector 17 is provided in the screw rod 12. An electrode of the atomization core 16 is electrically connected to the electrode connector 17. In this embodiment, the electrode connector 17 includes an insulation sleeve 171 and a thimble 172 that is inserted and secured in the insulation sleeve 171. The screw rod 12 and the thimble 172 are both made of metal. The electrode of the atomization core 16 is electrically connected to the screw rod 12 and the thimble 172, separately.

The above is only preferable implementation manners of the present invention, and the protection scope of the present invention is not limited to the embodiments. Any technical solution within the concept of the present invention shall fall within the protection scope of the present invention. It should be noted that for a person skilled in the art of ordinary skill in the art, the alternations and modifications made without departing from the principles of the present invention shall also fall within the protection scope of the present invention.

What is claimed is:

1. An e-cigarette comprising an e-cigarette atomizer and a battery component, the e-cigarette atomizer comprising:

an atomizer body comprising:

an open e-liquid chamber at one end of the atomizer body, an air guide tube extending along a length of the atomizer body, the open e-liquid chamber being disposed around the air guide tube, and an end portion of the air guide tube having a lock hook; and a pluggable locking type mouthpiece comprising:

a locking sleeve, the air guide tube being inserted in and in interference fit with the locking sleeve, a clamp spring bar, the lock hook abutting against an end face of the clamp spring bar to lock and connect the atomizer body and the pluggable locking type mouthpiece, and a plug connector that is inserted in an opening of the open e-liquid chamber and closes the open e-liquid chamber.

2. The e-cigarette according to claim 1, wherein a plurality of ribs is provided on an outer wall of the air guide tube, and the air guide tube being in interference fit with the locking sleeve via the plurality of ribs.

3. The e-cigarette according to claim 1, wherein an end portion of the lock hook has a guide slope.

4. The e-cigarette according to claim 1, wherein the atomizer body further comprises:

a glass tube and a screw rod that are connected to each other, an atomization tube and an atomization base being provided in the glass tube, the air guide tube inserted in the atomization base, the atomization tube sheathed around an outer side of a connection between the atomization base and the air guide tube, a sealing ring provided between the atomization base and an inner wall of the glass tube, the atomization base, an outer wall of the atomization tube, an outer wall of the air guide tube, and the inner wall of the glass tube form the open e-liquid chamber, and the atomization base comprising an atomization core, the screw rod comprising an electrode connector, and an electrode of the atomization core being electrically connected to the electrode connector.

5. The e-cigarette according to claim 4, wherein the electrode connector comprises an insulation sleeve and a thimble inserted and secured into the insulation sleeve, both the screw rod and the thimble being made of metal, and the electrode of the atomization core being separately electrically connected to each of the screw rod and the thimble.

6. The e-cigarette according to claim 1, wherein the pluggable locking type mouthpiece comprises:

a mouthpiece body, the locking sleeve fixedly provided in an inner chamber of the mouthpiece body, two or more of the clamp spring bars provided at an inner end portion of the locking sleeve, and the plug connector provided at an outer end portion of the locking sleeve.

7. The e-cigarette according to claim 6, wherein the locking sleeve is secured in the inner chamber of the mouthpiece body by ultrasonic welding.

8. The e-cigarette according to claim 7, wherein a first sealing ring is sheathed around an outer wall of the plug connector.

* * * * *